US010077410B2

(12) United States Patent
Qian

(10) Patent No.: US 10,077,410 B2
(45) Date of Patent: Sep. 18, 2018

(54) SYNERGISTIC LUBRICATING OIL COMPOSITION CONTAINING MIXTURE OF ANTIOXIDANTS

(71) Applicant: Chevron Oronite Company LLC, San Ramon, CA (US)

(72) Inventor: Xuelei Lily Qian, Fremont, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 15/209,272

(22) Filed: Jul. 13, 2016

(65) Prior Publication Data

US 2018/0016512 A1 Jan. 18, 2018

(51) Int. Cl.

| | |
|---|---|
| ***C10M 133/40*** | (2006.01) |
| ***C10M 141/12*** | (2006.01) |
| ***C10M 163/00*** | (2006.01) |

(52) U.S. Cl.

CPC ..... *C10M 133/40* (2013.01); *C10M 141/12* (2013.01); *C10M 163/00* (2013.01); *C10M 2205/028* (2013.01); *C10M 2207/026* (2013.01); *C10M 2207/028* (2013.01); *C10M 2215/064* (2013.01); *C10M 2215/221* (2013.01); *C10M 2215/28* (2013.01); *C10M 2215/30* (2013.01); *C10M 2219/022* (2013.01); *C10M 2219/046* (2013.01); *C10M 2219/068* (2013.01); *C10M 2219/082* (2013.01); *C10M 2219/087* (2013.01); *C10M 2219/108* (2013.01); *C10M 2223/04* (2013.01); *C10M 2223/043* (2013.01); *C10M 2223/045* (2013.01); *C10M 2223/047* (2013.01); *C10M 2223/049* (2013.01); *C10M 2223/06* (2013.01); *C10M 2223/063* (2013.01); *C10M 2223/08* (2013.01); *C10M 2227/066* (2013.01); *C10M 2227/09* (2013.01); *C10N 2210/02* (2013.01); *C10N 2210/06* (2013.01); *C10N 2220/027* (2013.01); *C10N 2220/028* (2013.01); *C10N 2230/04* (2013.01); *C10N 2230/06* (2013.01); *C10N 2230/10* (2013.01); *C10N 2240/10* (2013.01); *C10N 2260/14* (2013.01)

(58) Field of Classification Search

CPC ..... C10M 2215/221; C10M 2215/064; C10N 2210/06

USPC ..... 508/262, 362, 563

See application file for complete search history.

(56) References Cited

U.S. PATENT DOCUMENTS

| | | | |
|---|---|---|---|
| 2,346,156 | A | 4/1944 | Farrington et al. |
| 2,451,642 | A | 10/1948 | Watson |
| 2,718,501 | A | 9/1955 | Harle |
| 2,857,424 | A | 10/1958 | Cox |
| 2,883,362 | A | 4/1959 | Rosenwald et al. |
| 3,172,892 | A | 3/1965 | Le Suer et al. |
| 3,211,793 | A | 10/1965 | Roos |
| 3,219,666 | A | 11/1965 | Norman et al. |
| 3,272,746 | A | 9/1966 | Le Suer et al. |
| 3,480,635 | A | 11/1969 | Altwicker |
| 4,031,016 | A | 6/1977 | Berger et al. |
| 4,320,019 | A | 3/1982 | Hayashi |
| 5,198,130 | A | 3/1993 | Schumacher |
| 5,268,113 | A | 12/1993 | Evans |

(Continued)

FOREIGN PATENT DOCUMENTS

| | | |
|---|---|---|
| GB | 835826 | 5/1960 |
| GB | 1296592 | 11/1972 |

(Continued)

OTHER PUBLICATIONS

Mortier R.M. et al., 1992, "Chemistry and Technology of Lubricants Initiation", Chapter 4 VCH Publishers, Inc.

(Continued)

*Primary Examiner* — Vishal V Vasisth

(74) *Attorney, Agent, or Firm* — Ryan, Mason & Lewis, LLP

(57) ABSTRACT

Disclosed is a lubricating oil composition comprising an oil of lubricating viscosity and an oil soluble synergistic mixture of antioxidants, said mixture comprising:

a) a hindered amine antioxidant according to formula (I)

(I)

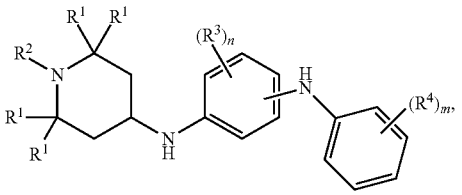

wherein each $R^1$ is independently selected from a substituted or unsubstituted, branched or linear, $C_1$-$C_{20}$ hydrocarbyl group; $R^2$ is selected from the group consisting of a hydrogen atom or a, substituted or unsubstituted, branched or linear, $C_1$-$C_{20}$ hydrocarbyl group; each $R^3$ is independently selected from the group consisting of a hydrogen atom or a, substituted or unsubstituted, branched or linear, $C_1$-$C_{20}$ hydrocarbyl group; each $R^4$ is independently selected from the group consisting of a hydrogen atom or a, substituted or unsubstituted, branched or linear, $C_1$-$C_{20}$ hydrocarbyl group; n is an integer from 1 to 4; and m is an integer from 1 to 5; and b) a molybdenum succinimide complex.

19 Claims, No Drawings

(56) References Cited

U.S. PATENT DOCUMENTS

| | | | |
|---|---|---|---|
| 5,457,204 | A | 10/1995 | Steinmann |
| 5,521,282 | A | 5/1996 | Steinmann |
| 5,534,618 | A | 7/1996 | Steinmann |
| 5,574,162 | A | 11/1996 | Galbo et al. |
| 5,711,767 | A | 1/1998 | Gande et al. |
| 5,962,683 | A | 10/1999 | Steinmann et al. |
| 6,001,905 | A | 12/1999 | Steinmann |
| 6,521,681 | B1 | 2/2003 | Zingg et al. |
| 6,962,896 | B2 | 11/2005 | Ruhe, Jr. et al. |
| 7,683,017 | B2 | 2/2010 | Cherpeck et al. |
| 2002/0013390 | A1 | 1/2002 | Gugumus |
| 2003/0197151 | A1 | 10/2003 | Gugumus |
| 2006/0189824 | A1 | 8/2006 | Kumar et al. |
| 2007/0006855 | A1 | 1/2007 | Malandro et al. |
| 2008/0051306 | A1 | 2/2008 | Chasan et al. |
| 2008/0220999 | A1 | 9/2008 | Chase et al. |
| 2008/0221000 | A1 | 9/2008 | Chase et al. |
| 2009/0156441 | A1 | 6/2009 | Rowland et al. |
| 2011/0077178 | A1 | 3/2011 | Chase et al. |
| 2012/0190864 | A1* | 7/2012 | Nelson ..... C07D 403/12 548/404 |

FOREIGN PATENT DOCUMENTS

| | | |
|---|---|---|
| JP | 2003292982 | 10/2003 |
| WO | 2008109523 | 9/2008 |
| WO | 2014017182 | 1/2014 |

OTHER PUBLICATIONS

Oberster, A. E. et al., Can. J. Chem. 1967, 45, 195-201.
Haidasz, E. A. et al. J. Am. Chem. Soc. 2016, 138, 5290-5298.

* cited by examiner

SYNERGISTIC LUBRICATING OIL COMPOSITION CONTAINING MIXTURE OF ANTIOXIDANTS

FIELD OF THE DISCLOSURE

The present disclosure generally relates to lubricating oil compositions which exhibit superior antioxidant and deposit control properties.

BACKGROUND OF THE DISCLOSURE

Inhibition of free radical-mediated oxidation is one of the most important reactions in organic substrates and is commonly used in rubbers, polymers and lubrication oils; namely, since these chemical products may undergo oxidative damage by the autoxidation process. Hydrocarbon oxidation is a three step process which comprises: initiation, propagation and termination. Oxidative degradation and the reaction mechanisms are dependent upon the specific hydrocarbons, temperatures, operating conditions, catalysts such as metals, etc., for which more details can be found in Chapter 4 of Mortier R. M. et al., 1992, "Chemistry and Technology of Lubricants Initiation", VCH Publishers, Inc.; which is incorporated herein by reference in its entirety. Initiation involves the reaction of oxygen or nitrogen oxides ($NO_x$) on a hydrocarbon molecule. Typically, initiation starts by the abstraction of hydrocarbon proton. This may result in the formation of hydrogen peroxide (HOOH) and radicals such as alkyl radicals ($R^{\bullet}$) and peroxy radicals ($ROO^{\bullet}$). During the propagation stage, hydroperoxides may decompose, either on their own or in the presence of catalysts such as metal ions, to alkoxy radicals ($RO^{\bullet}$) and peroxy radicals. These radicals can react with the hydrocarbons to form a variety of additional radicals and reactive oxygen containing compounds such as alcohols, aldehydes, ketones and carboxylic acids; which again can further polymerize or continue chain propagation. Termination results from the self termination of radicals or by reacting with oxidation inhibitors.

The uncatalyzed oxidation of hydrocarbons at temperatures of up to about 120° C. primarily leads to alkylhydroperoxides, dialkylperoxides, alcohols, ketones; as well as the products which result from cleavage of dihydroperoxides such as diketones, keto-aldehydes hydroxyketones and so forth. At higher temperatures (above 120° C.) the reaction rates are increased and cleavage of the hydroperoxides plays a more important role. Further polycondesation and polymerization reaction of these high molecular weight intermediates results in products which are no longer soluble in the hydrocarbon and form varnish like deposits and sludge.

Since autoxidation is a free-radical chain reaction, it therefore, can be inhibited at the initiation and/or propagation steps. Typical oxidation inhibition by diarylamines, such as dialkyldiphenylamine and N-phenyl-α-napthylamine, also involves radical scavenging. The transfer of hydrogen from the NH group of the amine to the peroxide radicals results in the formation of a diarylamino radical which is resonance stabilized, thus prevents new chains from forming. A secondary peroxy radical or hydroperoxide can react with the diarylamino radical to form the nitroxy radical, which is also a very potent inhibitor.

RELATED ART

US 20020013390 describes a stabilizer mixture contains: (A) a sterically hindered amine compound; and (B) two different compounds selected from organic and inorganic salts of zinc and magnesium in weight ratio 1:10 to 10:1. The mixture is free of perchloric acid. Combination (B) is not zinc oxide plus zinc stearate or zinc oxide plus hydrotalcite.

US20030197151 describes a stabilizer mixture for organic materials e.g. olefin polymers, comprises sterically hindered amine or amide, and low molecular weight, sterically hindered amines.

US 20060189824 describes various N-alkyl-N-(dialkylhydroxyphenyl)alkyl-N'-phenyl-para-phenylene diamines, methods for their preparation by Mannich reactions of dialkylphenols with N-phenyl-para-phenylenediamines, and their use as antioxidants.

US 20060128574 describes the use of secondary diarylamines in combination with N,N'-dialkyl-para-phenylenediamines, and optionally hindered phenolics, as stabilizers for lubricants and fuels. The following cyclohexyl phenylenediamines are claimed: N-cyclohexyl-N'-phenyl-para-phenylenediamine, N,N'-dicyclohexyl-para-phenylenediamine.

US 20070006855 describes the use of alkylated para-phenylenediamines as soot dispersants in passenger car and heavy-duly diesel engines equipped with exhaust gas recirculation systems (EGR).

US 20080051306 describes a composition useful as stabilized lubricant composition comprises mineral and synthetic base oil, and at least one sterically hindered amine compounds.

US 20080220999, describes new molybdenum compound useful as antioxidant for lubricant oils, is a reaction product of hindered amine; molybdenum source; and either water, or a reaction product of fatty oil with multifunctional amine, and water, or a diol and water.

US 20080221000, describes a lubricant composition, e.g. for use in internal combustion engines, that comprise of a lubricant base oil, oil soluble metal compound, and an oil soluble hindered amine.

US 20090156441 describes $C_5$-$C_{12}$ cycloalkyl substituted phenylenediamine that provides deposit-control lubricant additives for organic materials including lubricating oil, gasoline, and diesel fuels.

US 20110077178, describes a lubricant composition comprises lubricating base oil, oil-soluble metal compound e.g. molybdenum, titanium, and tungsten compounds, and oil-soluble hindered amine e.g. piperidine compounds and 4-stearoyloxy-2,2,6,6-tetramethylpiperidine.

U.S. Pat. No. 2,451,642 describes ortho-, meta-, and para-phenylenediamine as useful antioxidants for lubricating oil compositions for use in environments where iron-catalyzed oxidation reaction can take place. N,N'-dimethyl-ortho-phenylenediamine, N,N'-dimethyl-meta-phenylenediamine, lauryl-meta-phenylenediamine, N,N'-dicyclohexyl-para-phenylenediamine, and various di- and tetra-n-alkyl-para-phenylenediamines are similarly described.

U.S. Pat. No. 2,718,501 describes a stabilizer system consisting of an aromatic amine with at least two aromatic rings, including N,N'-diphenyl-para-phenylenediamine, and an organic aliphatic sulfur compound, which is said to be suitable for stabilizing mineral hydrocarbon lubricating oils, synthetic hydrocarbon oils, and polyalkylene glycol oils.

U.S. Pat. No. 2,857,424 describes the preparation of oxalic acid salts of fuel stabilizing N,N'-dialkyl-para-phenylenediamines as a way of rendering the additives less toxic. The preparation of the oxalate salt of N,N'-dicyclohexyl-para-phenylenediamine is disclosed. The preparation of the oxalate salts of other unspecified dicycloalkyl ortho-, meta-, and para-phenylenediamines is contemplated.

U.S. Pat. No. 2,883,362 describes the stabilization of rubber towards cracking by the addition of N,N,N',N'-tetraalkyl para-phenylenediamines. The only such compound disclosed wherein one or more of the alkyl groups is cycloalkyl is N,N'-dicyclohexyl-N,N'-dimethyl-para-phenylenediamine.

U.S. Pat. No. 3,211,793 describes the preparation of N,N'-dicyclohexyl-N-isobutenyl-para-phenylenediamine, exemplifying the utility as an antioxidant for rubber. U.S. Pat. No. 3,402,201 describes N,N'-dicyclooctyl-para-phenylenediamine as a stabilizer for organic materials, particularly rubber, and exemplifies its use as a gasoline inhibitor.

U.S. Pat. No. 3,480,635 describes N-piperidyl substituted phenylendiamines prepared by reductively alkylating a nitro or amino-substituted phenylamine with a piperdone. The compounds were useful as antioxidants.

U.S. Pat. No. 4,031,016 describes how the daylight stability of hydroprocessed oils is improved by adding thereto (1) singlet oxygen quenchers suitably selected from the class consisting of carotenes, aliphatic amines and heterocyclic amines, and (2) certain aromatic secondary amines as antioxidants.

U.S. Pat. No. 5,198,130 describes lubricant compositions containing a combination of zinc dialkyl (di)thiophosphates and certain 2,2,6,6-tetramethylpiperdine derivatives.

U.S. Pat. No. 5,268,113 describes a lubricating oil that stabilizes against oxidation by the addition of a hindered amine and a phenol.

U.S. Pat. No. 5,457,204 describes a hindered amine ester and phenol ether compounds useful as stabilizer for polymer or photographic material—contains hydroxy-tetramethylpiperidyloxy-propoxy groups, prevents oxidative, thermal and actinic degradation.

U.S. Pat. No. 5,521,282 describes polyethers with 2,2,6,6-tetramethylpiperidin-4-yl-oxymethyl side chains useful as stabilizer for organic material polymer e.g. acrylic, alkyd, polyurethane, polyester or polyamide against degradation by light, oxygen and/or heat.

U.S. Pat. No. 5,534,618 describes (co)polyether with hindered amine 2,2,6,6-tetramethyl-3- or -4-oxo-piperidinomethyl side chains and 2,2,6,6-tetramethyl-piperid-4-yl-oxymethyl side chains useful as stabilizer for organic material polymer e.g. acrylic, alkyd, polyurethane, polyester or polyamide against degradation by light, oxygen and/or heat.

U.S. Pat. No. 5,574,162 describes a 1-hydrocarbyloxy substituted hindered amine as polymer stabilizer containing a reactive functional group such as hydroxy, amino, oxirane or carboxyl allowing chemical attachment to the polymer.

U.S. Pat. No. 5,711,767 describes the use of certain phenylenediamines in combination with nitro des as stabilizers for gasoline. The following ortho-phenylenediamines are claimed: N,N'-di-sec-butyl-ortho-phenylenediamine, N,N'-di-(1,4-dimethylpentyl)-ortho-phenylenediamine, and N-sec-butyl-N'-phenyl-ortho-phenylenediamine. The following cyclohexyl phenylenediamines are claimed: N-cyclohexyl-N-phenyl-para-phenylenediamine, N,N'-dicyclohexyl-para-phenylenediamine.

U.S. Pat. No. 5,962,683 describes chemically combined hindered amine oxazoline compounds as light, oxygen and/or heat stabilizers for organic materials—especially for stabilizing thermoplastic polymer.

U.S. Pat. No. 6,001,905 describes hindered amine stabilizers for organic polymers and binders comprising of polyalkylene glycol diacid ester and amide derivatives with end groups containing 2,2,6,6-tetramethyl-piperidine rings.

U.S. Pat. No. 6,521,681 describes a mixture comprising benzofuran-2-one derivative(s) and sterically hindered amine(s) useful for stabilizing organic materials, e.g. polymers, polyolefin fibers, fats, oils and waxes, against degradation by oxidation, heat or light.

U.S. Pat. No. 7,683,017 describes a synergistic lubricating oil composition containing a mixture of a nitro-substituted diarylamine and a diarylamine.

GB 835,826 describes the reaction of certain phenylenediamines with alkyldihalides to make higher molecular weight compounds that are useful as antiozonants for rubber, N,N'-dicyclohexy-ortho-phenylenediamine, N,N'-dicyclohexyl-para-phenylenediamine, N,N'-dicyclohexyl-N-methyl-ortho-phenylenediamine, and N,N'-dicyclohexyl-N-methyl-para-phenylenediamine are disclosed as being suitable starting materials for this reaction.

GB 1,296,592 describes N-aryl, N-alkyl-N'-alkyl-N'-cycloalkyl-para-phenylenediamines, where aryl is phenyl or alkylphenyl, alkyl is an alkyl group containing from one to four carbons, and the cycloalkyl group contains from five to nine carbons. These compounds are useful as antioxidants for peroxide-crosslinked polyethylene.

JP 2003292982 describes a lubricating oil composition contains hindered amine type cleaning agent (A)(in mass %) (0.005-0.2), and poly-butenyl succinimide and/or derivative (s) of poly-butenyl succinimide (B) (0.05-4). The contents of compounds (A and B) are nitrogen element equivalent amounts based on entire quantity of the composition with reference to the base oil consisting of mineral oil and/or synthetic oil. The cleaning agent (A) is 2,2,6,6-tetralkyl piperidine derivative which has substituent in 4-position. The mass ratio of nitrogen content ((H)) of compound (A) to nitrogen content ((S)) of compound (B), i.e., ((H)/(S)), is from 0.1 to 1.

WO2008109523 describes a lubricant composition with an oil-soluble metal compound between 1 and 2,000 parts per million, with the metal compound being selected from molybdenum, tungsten, titanium, and boron, and an oil soluble hindered amine between 0.001-2 wt %.

WO2014017182 describes a lubrication oil with $NO_x$ resistance that comprises of a 2,2,6,6-tetraalkylpiperideinderivative and an organic molybdenum compound.

Oberster, A. E. et al., *Can. J. Chem* 1967, 45, 95-201, describes 39 novel phenylenediamines as part of a program to find antiozonants for rubber that are not sensitizers or dermatotoxic. In some compounds the N'-phenylenediamine nitrogen was variously fused into a pyrrolidine, piperidine, hexamethyleneimine (homopiperidine), morpholine, or 2,6-dimethylmorpholine ring. In each case the N-cyclohexyl compound was prepared.

Haidasz, E. A. et al. *J. Am. Chem. Soc.* 2016, 138, 5290-5298, DOI: 10.1021/jacs.6b00677 describes an antioxidant mechanism of hindered amines, and references cited within.

SUMMARY OF THE DISCLOSURE

In accordance with one embodiment of the present invention, disclosed is a lubricating oil composition which comprises an oil of lubricating viscosity and an oil soluble synergistic mixture of antioxidants, said mixture comprising:

a) a hindered amine antioxidant according to formula (I)

(I)

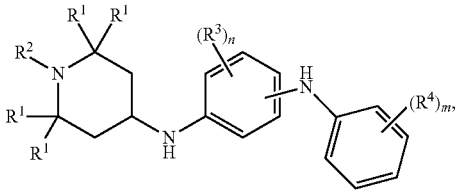

wherein each $R^1$ is independently selected from a substituted or unsubstituted, branched or linear, $C_1$-$C_{20}$ hydrocarbyl group; $R^2$ is selected from the group consisting of a hydrogen atom or a, substituted or unsubstituted, branched or linear, $C_1$-$C_{20}$ hydrocarbyl group; each $R^3$ is independently selected from the group consisting of a hydrogen atom or a, substituted or unsubstituted, branched or linear, $C_1$-$C_{20}$ hydrocarbyl group; each $R^4$ is independently selected from the group consisting of a hydrogen atom or a, substituted or unsubstituted, branched or linear, $C_1$-$C_{20}$ hydrocarbyl group; n is an integer from 1 to 4; and m is an integer from 1 to 5; and b) a molybdenum succinimide complex.

DETAILED DESCRIPTION

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

As used herein, the terms "hydrocarbon", "hydrocarbyl" or "hydrocarbon based" mean that the group being described has predominantly hydrocarbon character within the context of this disclosure. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this disclosure, these groups may contain atoms other than, carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019, which is expressly incorporated herein by reference, for relevant teachings in this regard.

It must be noted that as used in this specification and appended claims, the singular forms also include the plural unless the context clearly dictates otherwise. Thus the singular forms "a", "an", and "the" include the plural; for example "an amine" includes mixtures of amines of the same type. As another example the singular form "amine" is intended to include both singular and plural unless the context clearly indicates otherwise.

In an aspect, the present disclosure provides a lubricating oil composition comprising an oil of lubricating viscosity and a mixture of antioxidants, said mixture comprising:

a) a hindered amine antioxidant according to formula (I):

(I)

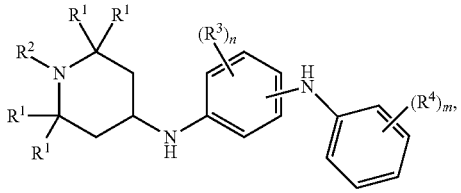

where each $R^1$ is independently selected from a substituted or unsubstituted, branched or linear, $C_1$-$C_{20}$ hydrocarbyl group; $R^2$ is selected from the group consisting of a hydrogen atom or a substituted or unsubstituted, branched or linear, $C_1$-$C_{20}$ hydrocarbyl group; each $R^3$ is independently selected from the group consisting of a hydrogen atom, or a substituted or unsubstituted, branched or linear $C_1$-$C_{20}$ hydrocarbyl group; each $R^4$ is independently selected from the group consisting of a hydrogen atom, or a substituted or unsubstituted, branched or linear $C_1$-$C_{20}$ hydrocarbyl group; n is an integer from 1 to 4; and m is an integer from 1 to 5; and b) a molybdenum succinimide complex.

Hindered Amine Antioxidant Compound—Component a)

Component a) is an oil soluble hindered amine compound. The term oil-soluble as used herein does not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired. The oil soluble hindered amine compound is present from 0.01 to 10, 0.05 to 7, 0.1 to 5, 0.1 to 4, 0.1 to 3, 0.2 to 2, 0.2 to 1.5, 0.2 to 1, and 0.2 to 0.5 weight % in the finished lubricating oil. In one embodiment, the hindered amine antioxidant has the following formula (II):

(II)

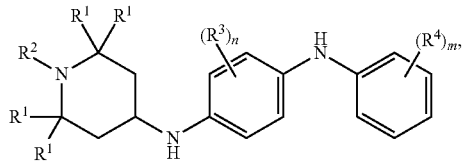

where each $R^1$ is independently selected from a substituted or unsubstituted, branched or linear, $C_1$-$C_{20}$ hydrocarbyl group; $R^2$ is selected from the group consisting of a hydrogen atom or, a substituted or unsubstituted, branched or linear $C_1$-$C_{20}$ hydrocarbyl group; each $R^3$ is independently selected from the group consisting of a hydrogen atom or, a substituted or unsubstituted, branched or linear $C_1$-$C_{20}$ hydrocarbyl group; each $R^4$ is independently selected from the group consisting of a hydrogen atom or, a substituted or unsubstituted, branched or linear $C_1$-$C_{20}$ hydrocarbyl group; n is an integer from 1 to 4; and m is an integer from 1 to 5. In one embodiment, each $R^1$ is independently selected from a substituted or unsubstituted, branched or linear $C_1$-$C_6$ hydrocarbyl group. In one embodiment, each $R^1$ is independently a methyl group. In one embodiment, R2 is a hydrogen atom. In one embodiment, $R^2$ is a, substituted or unsubstituted, branched or linear, $C_1$-$C_6$ hydrocarbyl group.

In one embodiment, the hindered amine antioxidant has the following formula (III):

(III)

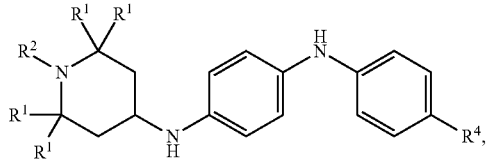

where each $R^1$ is independently selected from a substituted or unsubstituted, branched or linear $C_1$-$C_{20}$ hydrocarbyl group; $R^2$ is selected from the group consisting of a hydrogen atom or, a substituted or unsubstituted, branched or linear $C_1$-$C_{20}$ hydrocarbyl group; and $R^4$ is selected from the group consisting of a hydrogen atom or, a substituted or unsubstituted, branched or linear $C_1$-$C_{20}$ hydrocarbyl group.

In one embodiment, the hindered amine antioxidant has the following formula (IV):

(IV)

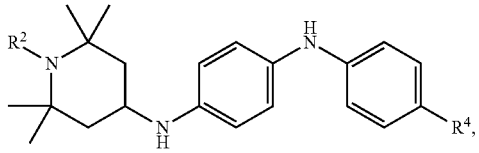

where $R^2$ is selected from the group consisting of a hydrogen atom or, a substituted or unsubstituted, branched or linear $C_1$-$C_{20}$ hydrocarbyl group; and $R^4$ is selected from the group consisting of a hydrogen atom or, a substituted or unsubstituted, branched or linear $C_1$-$C_{20}$ hydrocarbyl group.

In one embodiment, the hindered amine antioxidant has the following formula (V):

(V)

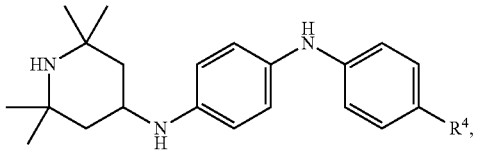

where $R^4$ is selected from the group consisting of a hydrogen atom or, a substituted or unsubstituted, branched or linear $C_1$-$C_{20}$ hydrocarbyl group.

Molybdenum Succinimide Complex—Component b)

Oil soluble molybdenum compounds and molybdenum/sulfur complexes are known in the art and are described, for example, in U.S. Pat. No. 4,263,152 to King et al., and U.S. Pat. No. 6,962,896 to Ruhe, the disclosures of which are hereby incorporated by reference and which are particularly preferred. The oil soluble molybdenum compounds and molybdenum/sulfur complexes is present from 0.01 to 8, 0.05 to 6, 0.1 to 5, 0.1 to 4, 0.1 to 3, 0.1 to 2, 0.1 to 1, and 0.1 to 0.5 weight % in the finished lubricating oil.

Particularly preferred oil soluble molybdenum complexes are unsulfurized or sulfurized oxymolybdenum containing compositions which can be prepared by (i) reacting an acidic molybdenum compound and a basic nitrogen dispersant succinimide in the presence of a polar promoter, to form an oxymolybdenum complex. This oxymolybdenum complex can be reacted with a sulfur containing compound, to thereby form a sulfurized oxymolybdenum containing composition, useful within the context of this disclosure. Preferably the dispersant is a polyisobutenyl succinimide. The oxymolybdenum or sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. The precise molecular formula of these oxymolybdenum compositions are not known with certainty. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions. In one aspect, the oxymolybdenum complex is prepared at a reaction temperature at or below 120 degrees centigrade and if optionally sulfurized, it is also reacted at or below 120 degrees centigrade. Such a process yields a lighter color product when compared to higher temperature reaction conditions at equivalent pressure.

The molybdenum compounds used to prepare the oxymolybdenum and oxymolybdenum/sulfur complexes employed in this disclosure are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compounds: molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3l_6$, molybdenum trioxide, bis(acetylacetonato)-dioxomolybdenum (V1) or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen succinimide used to prepare the oxymolybdenum complexes has at least one basic nitrogen, and is preferably oil-soluble. The succinimide compositions may be after-treated with, e.g., boron, using procedures well known in the art so long as the compositions continue to contain basic nitrogen.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine.

Succinimides having an average molecular weight of 1000 or 1300 or 2300 and mixtures thereof are most preferred. Such succinimides can be post treated with boron or ethylene carbonate as known in the art.

The oxymolybdenum complexes of this disclosure can also be sulfurized. Representative sulfur sources for preparing the oxymolybdenum/sulfur complexes used in this disclosure are sulfur, hydrogen sulfide, sulfur monochloride, sulfur dichloride, phosphorus pentasulfide, $R''_2S_x$ where R" is hydrocarbyl, preferably $C_{1-40}$ alkyl, and x is at least 2, inorganic sulfides and polysulfides such as $(NH_4)_2S_y$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof. These sulfur containing antioxidants are useful when employed as additional antioxidants since they are effective peroxide decomposers and are further described herein below.

The sulfurized fatty acid esters are prepared by reacting sulfur, sulfur monochloride, and/or sulfur dichloride with an unsaturated fatty ester under elevated temperatures. Typical esters include $C_1$-$C_{20}$ alkyl esters of $C_8$-$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, castor oil, peanut oil, rapeseed oil, fish oil, sperm oil, and so forth. Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$-$C_{25}$ olefins with fatty acid esters of $C_{10}$-$C_{25}$ fatty acids and $C_{10}$-$C_{25}$ alkyl or alkenyl alcohols, wherein the fatty acid and/or the alcohol is unsaturated may also be used.

Sulfurized olefins are prepared by the reaction of the $C_3$-$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compositions such as sulfurized dodecylphenol and the calcium salts thereof. The alkyl group ordinarily contains from 9-300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R'''_2S_z$ where R''' is hydrocarbyl, preferably $C_1$-$C_{10}$ alkyl, and z is at least 3, mercaptans wherein R''' is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this disclosure is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water. While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.H_2O$. Water may also be added as ammonium hydroxide.

A method for preparing the oxymolybdenum complexes used in this disclosure is to prepare a solution of the acidic molybdenum precursor and a polar promoter with a basic succinimide compound with or without diluent. The diluent is used, if necessary, to provide a suitable viscosity for easy stirring. Typical diluents are lubricating oil and liquid compounds containing only carbon and hydrogen.

If desired, this product can be sulfurized by treating this reaction mixture with a sulfur source as defined above at a suitable pressure and temperature, not to exceed about 120 degrees Celsius for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source.

In the reaction mixture, the reaction mixture will have charged to it from 0.01 to 2.00 atoms of molybdenum per basic nitrogen atom. Preferably from 0.3 to 1.0, and most preferably from 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. For extremely low sulfur incorporation the sulfur to molybdenum weight ratio can be from (0.01 to 0.08) to 1.

The sulfurized and unsulfurized oxymolybdenum complexes of this disclosure are typically employed in a lubricating oil in an amount of 0.01 to 5 wt %, more preferably from 0.04 to 1 wt %.

Secondary Diarylamine Antioxidant—Component c)

In one embodiment, the composition of the disclosure further comprises component c), an oil soluble secondary diarylamine antioxidant. The oil soluble secondary diarylamine antioxidant may be present from 0.01 to 10, 0.05 to 7, 0.1 to 5, 0.1 to 4, 0.1 to 3, 0.2 to 2, 0.2 to 1.5, 0.2 to 1, and 0.2 to 0.5 weight % in the finished lubricating oil.

Examples of some of the secondary diarylamines that are useful in the practice of the present disclosure include: diphenylamine, monoalkylated diphenylamine, dialkylated diphenylamine, trialkylated diphenylamine, or mixtures thereof, mono- and/or di-butyldiphenylamine, mono- and/or di-octyldiphenylamine, mono- and/or di-nonyldiphenylamine, diheptyldiphenylamine, mixtures of mono- and dialkylated t-butyl-t-octyldiphenylamine.

Examples of commercial diarylamines include, for example, IRGANOX L06, IRGANOX L57 and IRGANOX L67 from BASF Corporation; NAUGALUBE AMS, NAUGALUBE APAN, NAUGALUBE PANA, NAUGALUBE 438, NAUGALUBE 438R, NAUGALUBE 438L, NAUGALUBE 500, NAUGALUBE 640, NAUGALUBE 680, NAUGALUBE 750 from Chemtura Corporation; ETHANOX 5057 from SI Group, Inc., VANLUBE DND, VANLUBE NA, VANLUBE PNA, VANLUBE SL, VANLUBE SLHP, VANLUBE SS, VANLUBE 81, VANLUBE 848, and VANLUBE 849 from R. T. Vanderbilt Company Inc, WINGSTAY 29A from Omnova Solutions.

In one embodiment, the diphenylamine antioxidant does not contain a nitro group.

The concentration of the secondary diarylamine in the lubricating oil composition can vary depending upon the requirements, applications and degree of synergy desired. In a preferred embodiment of the disclosure, a practical secondary diarylamine use range in the lubricating oil composition is from about 1,000 parts per million to 50,000 parts per million (i.e. 0.1 to 5.0 wt %) based on the total weight of the lubricating oil composition, preferably the concentration is from 1,000 to 10,000 parts per million (ppm) and more preferably from about 2,000 to 8,000 ppm by weight.

Typically, with regard to total antioxidant in the lubricating oil composition, quantities of less than 1,000 ppm have little or minimal effectiveness whereas quantities larger than 50,000 ppm are generally not economical. Preferably the total amount of component a) and component b) in the lubricating oil composition is from about 0.1 to 3 wt % and more preferably from about 0.1 to 2 wt % and most preferably from about 0.5 to about 2 wt % based upon the total weight of the lubricating oil composition. Preferably the total amount of component a) component b) and component c) in the lubricating oil is less than 5 wt. % and more preferably less than 2 wt. % based upon the total weight of the lubricating oil composition.

Additional components may be added to the synergistic combination of component a), component b) and optionally, component c) to further the resistance to oxidation of the organic substrate and which may add to the synergism. Hindered phenol may be optionally added. Particularly preferred is a component which operates as a peroxy radical scavenger. These hydroperoxide decomposers convert hydroperoxides into non-radical products thus preventing chain propagation reactions. Commonly, organosulfur and organophophorous compounds have served this purpose. Many suitable compounds which have identified herein above with regard the oxymolybdenum component need not be repeated again. Particularly preferred organophosphorous compounds are the oil-soluble, phosphorus-containing, antiwear compounds selected from the group consisting of metal dithiophosphates, phosphorus esters (including phosphates, phosphonates, phosphinates, phosphine oxides, phosphites, phosphonites, phosphinites, phosphines and the like), amine phosphates and amine phosphinates, sulfur-containing phosphorus esters including phosphoro monothionate and phosphoro dithionates, phosphoramides, phosphonamides and the like. More preferably, the phosphorus-containing compound is a metal dithiophosphate and, even more preferably, a zinc dithiophosphate. Suitable phosphorous compounds are disclosed in U.S. Pat. No. 6,696,393, incorporated herein by reference.

The Oil of Lubricating Viscosity

The neutral oil may be selected from Group I base stock, Group II base stock, Group III base stock, Group IV or poly-alpha-olefins (PAO), Group V, or base oil blends thereof. The base stock or base stock blend preferably has a saturate content of at least 65%, more preferably at least 75%; a sulfur content of less than 1%, preferably less than 0.6%, by weight; and a viscosity index of at least 85, preferably at least 100. These base stocks can be defined as follows:

Group I: base stocks containing less than 90% saturates and/or greater than 0.03% sulfur and having a viscosity index greater than or equal to 80 and less than 120 using test methods specified in Table 1 of the American Petroleum Institute (API) publication "Engine Oil Licensing and Certification Sheet" Industry Services Department, 14th Ed., December 1996, Addendum I, December 1998;

Group II: base stocks containing greater than or equal to 90% saturates and/or greater than 0.03% sulfur and having a viscosity index greater than or equal to 80 and less than 120 using test methods specified in Table 1 referenced above;

Group III: base stocks which are less than or equal to 0.03% sulfur, greater than or equal to 90% saturates, and greater than or equal to 120 using test methods specified in Table 1 referenced above.

Group IV: base stocks which comprise PAO's.

Group V: base stocks include all other base stocks not included in Group I, II, III, or IV.

For these definitions, saturates level can be determined by ASTM D 2007, the viscosity index can be determined by ASTM D 2270; and sulfur content by any one of ASTM D 2622, ASTM D 4294, ASTM D 4927, or ASTM D 3120.

Additional Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with additional antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

Example 1

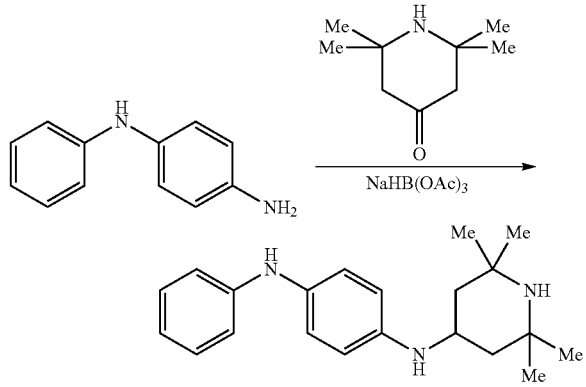

Synthesis of $N^1$-phenyl-$N^4$-(2,2,6,6-tetramethylpiperidin-4-yl)benzene-1,4-diamine To a solution 1,1,6,6-tetramethyl-4-piperidone (24.4 g, 0.157 mol, 1.0 equiv) and N-phenyl-p-phenylenediamine (28.9 g, 0.157 mol, 1.0 equiv) in 1,2-dichloroethane (300 mLs) was added sodium triacetoxyborohydride (46.6 g, 0.220 mol, 1.4 equiv) and acetic acid (9.43 g, 0.157 mol, 1 equiv). The reaction mixture was stirred at ambient temperature for 48 h under $N_2$. The reaction mixture was neutralized with 1N sodium hydroxide (150 mLs), the layers were separated, and the aqueous layer was extracted with 3×150 mLs of EtOAc. The organic layers were combined, dried over $Na_2SO_4$, filtered, and concentrated under reduced pressure. Purification by silica gel chromatography (100:0→50:50 hexanes-EtOAc, 3-5 wt % $NEt_3$) afforded the desired product in 67% yield (34 g): $^1$H NMR ($CDCl_3$) δ 7.21 (t, J=8.4 Hz, 2H), 7.04 (d, J=8.6 Hz, 2H), 6.87 (d, J=8.4 Hz, 2H), 6.81 (t, J=7.3 Hz, 1H), 6.63 (d, J=8.7 Hz, 2H), 5.42 (br s, 1H), 3.74 (tt, J=11.7, 3.4 Hz, 1H), 2.09 (dd, J=12.7, 3.4 Hz, 2H), 1.32 (s, 6H), 1.18 (s, 6H), 0.94 (t, J=12 Hz, 2H). TBN: 272, N wt. %=12.99%

Example 2

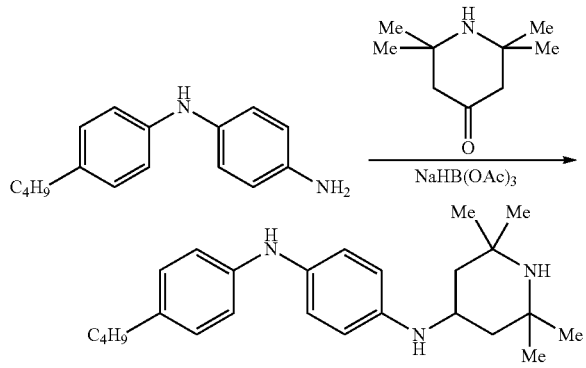

Synthesis of $N^1$-(4-butylphenyl)-$N^4$-(2,2,6,6-tetramethylpiperidin-4-yl)benzene-1,4-diamine To a solution 1,1,6,6-tetramethyl-4-piperidone (1.03 g, 0.007 mol, 1.0 equiv) and N-(4-butylphenyl)benzene,1,4-diamine (1.6 g, 0.007 mol, 1.0 equiv) in 1,2-dichloroethane (35 mL) was added sodium triacetoxyborohydride (2.15 g, 0.009 mol, 1.4 equiv) and acetic acid (0.4 g, 0.007 mol, 1 equiv). The reaction mixture was stirred at ambient temperature for 24 h under $N_2$. The reaction mixture was neutralized with 1N sodium hydroxide (70 mL), the layers were separated, and the aqueous layer was extracted with 3×35 mLs of EtOAc. The organic layers were combined, dried over $Na_2SO_4$, filtered, and concentrated under reduced pressure. Purification by silica gel chromatography (0→100 hexanes-EtOAc, 3-5 wt % $NEt_3$) afforded the desired product in 40% yield (1 g): $^1$H NMR ($CDCl_3$) δ 7.02 (m, 4H), 6.82 (d, J=8.4 Hz, 2H), 6.61 (d, J=8.7 Hz, 2H), 5.33 (br s, 1H), 3.73 (tt, J=11.9, 3.5 Hz, 1H), 2.54 (t, J=7.7 Hz, 2H), 2.08 (dd, J=12.9, 3.4 Hz, 2H), 1.58 (quint, 2H), 1.58 (m, 2H), 1.36 (m, 2H), 1.33 (s, 6H1.27 (s, 1H), 1.21 (s, 6H), 0.94 (m, 5H).

Example 3

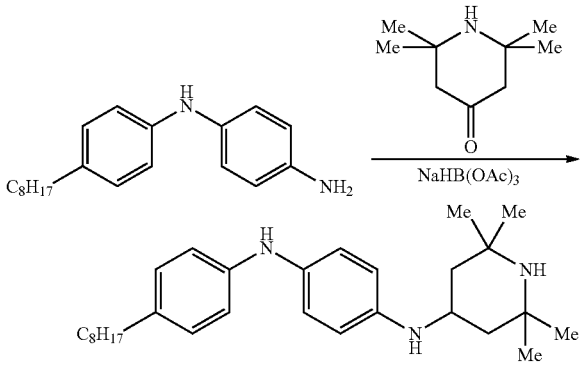

Synthesis of $N^1$-(4-octylphenyl)-$N^4$-(2,2,6,6-tetramethylpiperidin-4-yl)benzene-1,4-diamine To a solution 1,1,6,6-tetramethyl-4-piperidone (1.3 g, 0.0081 mol, 1.0 equiv) and N-(4-octylphenyl)benzene,1,4-diamine (2.4 g, 0.0081 mol, 1.0 equiv) in 1,2-dichloroethane (60 mL) was added sodium triacetoxyborohydride (2.4 g, 0.011 mol, 1.4 equiv) and acetic acid (0.48 g, 0.0081 mol, 1 equiv). The reaction mixture was stirred at ambient temperature for 24 h under $N_2$. The reaction mixture was neutralized with 1N sodium hydroxide (60 mLs), and the layers were separated, and the aqueous layer was extracted with 3×60 mLs of EtOAc. The organic layers were combined, dried over $Na_2SO_4$, filtered, and concentrated under reduced pressure. Purification by silica gel chromatography (0→100 hexanes-EtOAc, 3-5 wt % $NEt_3$) afforded the desired product in 50% yield (1.6 g): $^1$H NMR ($CDCl_3$) δ 6.98 (t, J=9.1 Hz, 4H), 6.79 (d, J=8.5 Hz, 2H), 6.59 (d, J=8.7 Hz, 2H), 5.30 (s, 1H), 3.68 (m, J=, Hz, 1H), 3.70 (tt, J=11.5, 3.4 Hz, 1H), 2.50 (t, J=7.7 Hz, 2H), 2.06 (dd, J=13.0, 3.5 Hz, 2H), 1.56 (quint, J=7.4 Hz, 2H), 1.31 (s, 6H), 1.29 (m, 12H), 1.19 (s, 6H), 0.87 (t, J=6.9 Hz, 3H).

Example 4

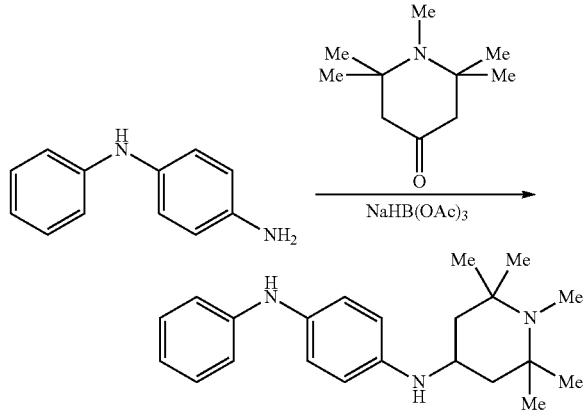

Synthesis of N1-(1,2,2,6,6-pentamethylpiperidin-4-yl)-N4-phenylbenzene-1,4-diamine To a solution 1,2,2,6,6-pentamethyl-4-piperidone (2.07 g, 0.0122 mol, 1.0 equiv) and N-phenyl-p-phenylenediamine (2.259 g, 0.0122 mol, 1.0 equiv) in 1,2-dichloroethane (85 mL) was added sodium triacetoxyborohydride (3.62 g, 0.0.171 mol, 1.4 equiv) and acetic acid (0.73 g, 0.0122 mol, 1 equiv). The reaction mixture was stirred at ambient temperature for 16 h under $N_2$. The reaction mixture was neutralized with 1N sodium hydroxide (150 mL), the layers were separated, and the aqueous layer was extracted with 3×150 mL of $CH_2Cl_2$. The organic layers were combined, dried over $Na_2SO_4$, filtered, and concentrated under reduced pressure. Purified by silica gel chromatography (hexanes/EtOAc: 70:30-0:100) afforded the desired product in 10% yield (0.39 g): $^1$H NMR ($CDCl_3$) δ 7.17 (t, J=7.9 Hz, 2H), 6.99 (d, J=8.7 Hz, 2H), 6.83 (d, J=7.7 Hz, 2H), 6.76 (t, J=7.3 Hz, 1H), 6.58 (d, J=8.7 Hz, 2H), 5.37 (br s, 1H), 3.58 (tt=11.6, 3.4 Hz, 1H), 2.27 (s, 3H), 1.95 (m, 2H), 1.24 (t, J=11.9 Hz, 2H) 1.16 (s, 6H), 1.1 (s, 6H).

Baseline Formulation

The base line formulation contained a Group 2 base oil, dialkyl zinc dithiophosphate, mixture of polyisobutenyl succinimide dispersants, calcium sulfonate and phenate detergents, a borated friction modifier, a pour point depressant, and an olefin copolymer viscosity index improver.

Example 5

A lubricating oil composition was prepared by adding 1.0 wt. % of the lubricating oil additive of Example 1 and 0.4 wt. % of moly succinimide according to that described herein to the formulation baseline.

Example 6

A lubricating oil composition was prepared by adding 0.2 wt. % of the lubricating oil additive of Example 1, 0.4 wt. % of moly succinimide according to that described herein, and 0.8 wt. % of a dialkylated diphenylamine antioxidant to the formulation baseline.

Example 7

A lubricating oil composition was prepared by adding 0.3 wt. % of the lubricating oil additive of Example 1, 0.4 wt.

% of moly succinimide according to that described herein, and 0.7 wt. % of a dialkylated diphenylamine antioxidant to the formulation baseline.

Example 8

A lubricating oil composition was prepared by adding 0.5 wt. % of the lubricating oil additive of Example 1, 0.4 wt. % of moly succinimide according to that described herein, and 05 wt. % of a dialkylated diphenylamine antioxidant to the formulation baseline.

Example 9

A lubricating oil composition was prepared by adding 0.5 wt. % of the lubricating oil additive of Example 2, 0.4 wt. % of moly succinimide according to that described herein, and 0.5 wt. % of a dialkylated diphenylamine antioxidant to the formulation baseline.

Example 10

A lubricating oil composition was prepared by adding 0.5 wt. % of the lubricating oil additive of Example 3, 0.4 wt. % of moly succinimide according to that described herein, and 0.5 wt. % of a dialkylated diphenylamine antioxidant to the formulation baseline.

Comparative Example 11

A lubricating oil composition was prepared by adding 0.5 wt. % of the lubricating oil additive of Example 1 and 0.5 wt. % of a dialkylated diphenylamine antioxidant to the formulation baseline.

Comparative Example 12

A lubricating oil composition was prepared by adding 1.0 wt. % of a dialkylated diphenylamine antioxidant to the formulation baseline.

Comparative Example 13

A lubricating oil composition was prepared by adding 1.5 wt. % of a dialkylated diphenylamine antioxidant to the formulation baseline.

Comparative Example 14

A lubricating oil composition was prepared by adding 1.0 wt % of Naugalube® APAN (Alkylated phenyl-alpha naphthylamine from Chemtura) to the formulation baseline.

Comparative Example 15

A lubricating oil composition was prepared by adding 1.0 wt % Naugard® PANA (Phenyl-alpha-napthylaylamine from Chemtura) to the formulation baseline.

Comparative Example 16

A lubricating oil composition was prepared by adding 0.4 wt. % of moly succinimide according to that described herein and 1.0 wt. % of a dialkylated diphenylamine antioxidant to the formulation baseline.

Comparative Example 17

A lubricating oil composition was prepared by adding 1.0 wt. % of the lubricating oil additive of Example 1 to the formulation baseline.

Comparative Example 18

A lubricating oil composition was prepared by adding 1.5 wt. % of the lubricating oil additive of Example 1 to the formulation baseline.

Oxidator Bx Test

Oxidation studies of the products of selected Examples were carried out in a bulk oil oxidation bench test as described by E. S. Yamaguchi et al. in Tribology Transactions, Vol. 42(4), 895-901 (1999). In this test the rate of oxygen uptake at constant pressure by a given weight of oil was monitored. The time required (induction time) for rapid oxygen uptake per 25 grams of sample was measured at 171° C. under 1.0 atmosphere of oxygen pressure. The sample was stirred at 1000 revolutions per minute. The results are reported, however, as time for rapid oxygen uptake per 100 grams of sample. The oil contained a catalyst added as oil soluble naphthenates to provide 26 ppm iron, 45 ppm copper, 512 ppm lead, 2.3 ppm manganese, and 24 ppm tin.

TEOST MHT4 Test—ASTM 7097

TEOST MHT4 is a proposed procedure for performance category GF-5. ASTM D7097 is designed to predict the deposit-forming tendencies of engine oil in the piston ring belt and upper piston crown area. Correlation has been shown between the TEOST MHT procedure and the TU3MH Peugeot engine test in deposit formation. This test determines the mass of deposit formed on a specially constructed test rod exposed to repetitive passage of 8.5 g of engine oil over the rod in a thin film under oxidative and catalytic conditions at 285° C. Deposit-forming tendencies of an engine oil under oxidative conditions are determined by circulating an oil-catalyst mixture comprising a small sample (8.4 g) of the oil and a very small (0.1 g) amount of an organometallic catalyst. This mixture is circulated for 24 hours in the TEOST MHT4 instrument over a special wire-wound depositor rod heated by electrical current to a controlled temperature of 285° C. at the hottest location on the rod. The rod is weighed before and after the test. Deposit weight of 35 mg is considered as pass/fail criteria.

A copy of this test method can be obtained from ASTM International at 100 Barr Harbor Drive, PO Box 0700, West Conshohocken, Pa. 19428-2959 and is herein incorporated for all purposes.

TABLE 1

| Example | Description | Oxidation Inhibition Properties (Ox Bx) (hr to rapid $O_2$ uptake) | TEOST MHT4 Test (deposit mg) |
|---|---|---|---|
| Example 5 | 1.0 wt % Hindered Amine antioxidant of Example 1 + 0.4 wt % Molybdenum Succinimide | 45.7 | 20.1 |

TABLE 1-continued

| Example | Description | Oxidation Inhibition Properties (Ox Bx) (hr to rapid $O_2$ uptake) | TEOST MHT4 Test (deposit mg) |
|---|---|---|---|
| Example 6 | 0.2 wt % Hindered Amine antioxidant of Example 1 + 0.4 wt % Molybdenum Succinimide + 0.8 wt % DPA | 57.4 | 34.7 |
| Example 7 | 0.3 wt % Hindered Amine antioxidant of Example 1 + 0.4 wt % Molybdenum Succinimide + 0.7 wt % DPA | 51.4 | 29.7 |
| Example 8 | 0.5 wt % Hindered Amine antioxidant of Example 1 + 0.4 wt % Molybdenum Succinimide + 0.5 wt % DPA | 58.0 | 22.5 |
| Example 9 | 0.5 wt % Hindered Amine antioxidant of Example 2 + 0.4 wt % Molybdenum Succinimide + 0.5 wt % DPA | 51.0 | 35.8 |
| Example 10 | 0.5 wt % Hindered Amine antioxidant of Example 3 + 0.4 wt % Molybdenum Succinimide + 0.5 wt % DPA | 47.9 | 37.4 |
| Comparative Example 11 | 0.5 wt % Hindered Amine antioxidant of Example 1 + 0.5 wt % DPA | 33.2 | 31.7 |
| Comparative Example 12 | 1.0 wt % DPA | 24.2 | 48.4 |
| Comparative Example 13 | 1.5 wt % DPA | 27.4 | NM |
| Comparative Example 14 | 1.0 wt % Naugalube ® APAN (Alkylated phenyl-alpha naphthylamine from Chemtura) | 27.3 | 43.3 |
| Comparative Example 15 | 1.0 wt % Naugard® PANA (Phenyl-alpha-naphthylamine from Chemtura) | 32.6 | 47.6 |
| Comparative Example 16 | 1.0 wt % DPA + 0.4 wt % Molybdenum Succinimide | 31.6 | 39.9 |
| Comparative Example 17 | 1.0 wt % Hindered Amine antioxidant of Example 1 | 35.4 | 38.9 |
| Comparative Example 18 | 1.5 wt % Hindered Amine antioxidant of Example 1 | 63.5 | 30.2 |

The Oxidator Bx test measures oxygen uptaken time. Higher test hours correlate to longer lifetimes of the antioxidant mixture. The synergistic effects described in this invention are found in examples 5-10, and show superior antioxidancy performance by the oxidator Bx test over comparative examples 11-17. Comparative Example 18 shows that high treat rates of antioxidants are needed to rival the performance of amines from examples 1-3 in combination of a molybdenum succinimide (Examples 5-10).

The TEOST MHT4 test (ASTM 7097) is a deposit-forming test, and there is an inverse relationship between the amount of deposits formed and performance of the antioxidant. The beneficial combinations of the amine in Example 1 with a molybdenum succinimide (Example 5), and optionally a DPA (Examples 6-10) generally show lower deposits compared to single amine formulations, either with or without combination of a molybdenum succinimide (Examples 12, 14-17).

What is claimed is:

1. A lubricating oil composition comprising an oil of lubricating viscosity and an oil soluble synergistic mixture of antioxidants, said mixture comprising:

a) 0.2 to 2 wt. %, based on the total weight of the lubricating oil composition, of a hindered amine antioxidant according to formula (I):

(I)

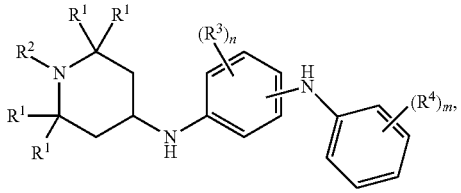

wherein each R1 is independently selected from a substituted or unsubstituted, branched or linear, C1-C20 hydrocarbyl group; R2 is selected from the group consisting of a hydrogen atom or a, substituted or unsubstituted, branched or linear, C1-C20 hydrocarbyl group; each R3 is independently selected from the group consisting of a hydrogen atom or a, substituted or unsubstituted, branched or linear, C1-C20 hydrocarbyl group; each R4 is independently selected from the group consisting of a hydrogen atom or a, substituted or unsubstituted, branched or linear, C1-C20 hydrocarbyl group; n is an integer from 1 to 4; and m is an integer from 1 to 5;

b) 0.1 to 2 wt. %, based on the total weight of the lubricating oil composition, of a molybdenum succinimide complex; and c) 0.2 to 2 wt. %, based on the total weight of the lubricating oil composition, of a dialkylated diphenylamine antioxidant different from that of formula I.

2. The lubricating oil composition according to claim 1, wherein the hindered amine antioxidant has the following formula (II):

(II)

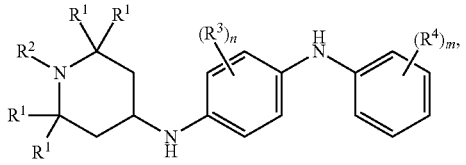

wherein each R1 is independently selected from a substituted or unsubstituted, branched or linear, C1-C20 hydrocarbyl group; R2 is selected from the group consisting of a hydrogen atom or a, substituted or unsubstituted, branched or linear, C1-C20 hydrocarbyl group; each R3 is independently selected from the group consisting of a hydrogen atom or a, substituted or unsubstituted, branched or linear, C1-C20 hydrocarbyl group; each R4 is independently selected from the group consisting of a hydrogen atom or a, substituted or unsubstituted, branched or linear, C1-C20 hydrocarbyl group; n is an integer from 1 to 4; and m is an integer from 1 to 5.

3. The lubricating oil composition according to claim 1, wherein the hindered amine antioxidant has the following formula (III):

(III)

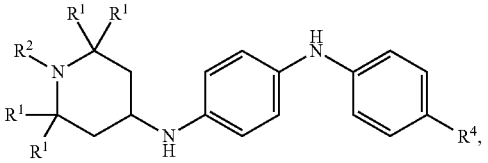

wherein each R1 is independently selected from a substituted or unsubstituted, branched or linear, C1-C20 hydrocarbyl group; R2 is selected from the group consisting of a hydrogen atom or a, substituted or unsubstituted, branched or linear, C1-C20 hydrocarbyl group; and R4 is selected from the group consisting of a hydrogen atom or a, substituted or unsubstituted, branched or linear, C1-C20 hydrocarbyl group.

4. The lubricating oil composition according to claim 1, wherein the hindered amine antioxidant has the following formula (IV):

(IV)

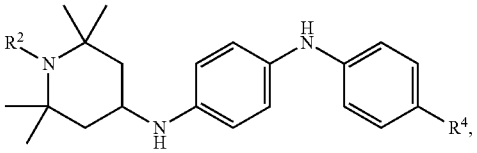

wherein R2 is selected from the group consisting of a hydrogen atom or a, substituted or unsubstituted, branched or linear, C1-C20 hydrocarbyl group; and R4 is selected from the group consisting of a hydrogen atom or a, substituted or unsubstituted, branched or linear, C1-C20 hydrocarbyl group.

5. The lubricating oil composition according to claim 1, wherein the hindered amine antioxidant has the following formula (V):

(V)

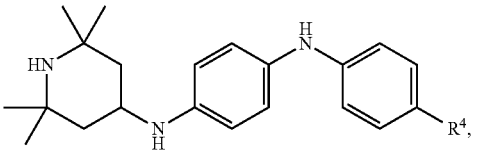

wherein R4 is selected from the group consisting of a hydrogen atom or a, substituted or unsubstituted, branched or linear, C1-C20 hydrocarbyl group.

6. The lubricating oil composition according to claim 1, wherein the dialkylated diphenylamine antioxidant is selected from the group consisting of di-butyldiphenylamine, di-octyldiphenylamine, di-nonyldiphenylamine, t-butyl-t-octyldiphenylamine, and mixtures thereof.

7. The lubricating oil composition according to claim 1, further comprising an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides.

8. The lubricating oil composition according to claim 7, wherein said phosphorus esters are selected from the group consisting of phosphates, phosphonates, phosphinates, phosphine oxides, phosphites, phosphorites, phosphinites, and phosphines.

9. The lubricating oil composition according to claim 7, wherein the oil-soluble, phosphorus-containing, anti-wear compound is a metal dithiophosphate.

10. The lubricating oil composition according to claim 9, wherein the metal dithiophosphate is a zinc dialkyldithiophosphate.

11. The lubricating oil composition according to claim 1, further comprising supplemental antioxidant selected from the group consisting of hindered phenols, hindered bisphenols, sulfurized phenols, sulfurized olefins, alkyl sulfides, polysulfides, dialkyl dithiocarbamates and phenothiazines.

12. A method for improving oxidation and reducing deposit formation in an engine comprising the steps of: first lubricating said engine with the lubricating oil composition according to claim 1, and then operating said engine.

13. A lubricating oil composition comprising an oil of lubricating viscosity and an oil soluble synergistic mixture of antioxidants, said mixture comprising:

a) 0.2 to 2 wt. %, based on the total weight of the lubricating oil composition, of a hindered amine antioxidant according to formula (I):

(I)

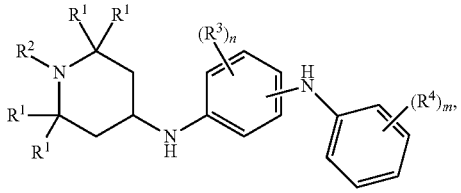

wherein each R1 is independently selected from a substituted or unsubstituted, branched or linear, C1-C20 hydrocarbyl group; R2 is selected from the group consisting of a hydrogen atom or a, substituted or unsubstituted, branched or linear, C1-C20 hydrocarbyl group; each R3 is independently selected from the group consisting of a hydrogen atom or a, substituted or unsubstituted, branched or linear, C1-C20 hydrocarbyl group; each R4 is independently selected from the group consisting of a hydrogen atom or a, substituted or unsubstituted, branched or linear, C1-C20 hydrocarbyl group; n is an integer from 1 to 4; and m is an integer from 1 to 5;

b) 0.1 to 2 wt. %, based on the total weight of the lubricating oil composition, of a molybdenum succinimide complex; and c) 0.2 to 2 wt. %, based on the total weight of the lubricating oil composition, of a dialkylated diphenylamine antioxidant different from that of formula I, wherein antioxidants (a) and (c) are present in an amount to yield an oxidation inhibition of at least 10%, according to the Oxidator Bx test, over a lubricating oil composition comprising either antioxidant (a) or (c) alone.

14. The lubricating oil composition according to claim 13, wherein the dialkylated diphenylamine antioxidant is selected from the group consisting of di-butyldiphenylamine, di-octyldiphenylamine, di-nonyldiphenylamine, t-butyl-t-octyldiphenylamine, and mixtures thereof.

15. The lubricating oil composition according to claim 13, further comprising an oil-soluble, phosphorus-containing, anti-wear compound selected from the group consisting of metal dithiophosphates, phosphorus esters, amine phosphates and amine phosphinates, sulfur-containing phosphorus esters, phosphoramides and phosphonamides.

16. The lubricating oil composition according to claim 1, comprising:

a) 0.2 to 1.5 wt. %, based on the total weight of the lubricating oil composition, of the hindered amine antioxidant according to formula (I);

b) 0.1 to 1 wt. %, based on the total weight of the lubricating oil composition, of the molybdenum succinimide complex; and c) 0.2 to 1.5 wt. %, based on the total weight of the lubricating oil composition, of the dialkylated diphenylamine antioxidant different from that of formula I.

17. The lubricating oil composition according to claim 1, comprising:

a) 0.2 to 1 wt. %, based on the total weight of the lubricating oil composition, of the hindered amine antioxidant according to formula (I);

b) 0.1 to 1 wt. %, based on the total weight of the lubricating oil composition, of the molybdenum succinimide complex; and c) 0.2 to 1 wt. %, based on the total weight of the lubricating oil composition, of the dialkylated diphenylamine antioxidant different from that of formula I.

18. The lubricating oil composition according to claim 13, comprising:

a) 0.2 to 1.5 wt. %, based on the total weight of the lubricating oil composition, of the hindered amine antioxidant according to formula (I);

b) 0.1 to 1 wt. %, based on the total weight of the lubricating oil composition, of the molybdenum succinimide complex; and c) 0.2 to 1.5 wt. %, based on the total weight of the lubricating oil composition, of the dialkylated diphenylamine antioxidant different from that of formula I.

19. The lubricating oil composition according to claim 13, comprising:

a) 0.2 to 1 wt. %, based on the total weight of the lubricating oil composition, of the hindered amine antioxidant according to formula (I);

b) 0.1 to 1 wt. %, based on the total weight of the lubricating oil composition, of the molybdenum succinimide complex; and c) 0.2 to 1 wt. %, based on the total weight of the lubricating oil composition, of the dialkylated diphenylamine antioxidant different from that of formula I.

* * * * *